United States Patent [19]

Gannaway

[11] Patent Number: 4,601,644

[45] Date of Patent: Jul. 22, 1986

[54] MAIN BEARING FOR A ROTARY COMPRESSOR

[75] Inventor: Edwin L. Gannaway, Adrian, Mich.

[73] Assignee: Tecumseh Products Company, Tecumseh, Mich.

[21] Appl. No.: 670,309

[22] Filed: Nov. 13, 1984

[51] Int. Cl.[4] ..... F04B 17/00

[52] U.S. Cl. ..... 417/363; 417/410; 417/902

[58] Field of Search ..... 417/902, 410, 363, 366; 384/439, 428

[56] References Cited

U.S. PATENT DOCUMENTS

| | | | |
|---|---|---|---|
| 2,864,550 | 12/1958 | Weibel, Jr. et al. . | |
| 2,868,443 | 1/1959 | Dolza . | |
| 3,082,937 | 3/1963 | Tucker | 417/372 |
| 3,367,609 | 2/1968 | Latter | 417/363 |
| 3,441,203 | 4/1969 | Larsen et al. | 417/363 |
| 3,504,953 | 4/1970 | Love . | |
| 3,666,380 | 5/1972 | Ellis | 417/902 |

*Primary Examiner*—Carlton R. Croyle
*Assistant Examiner*—Donald E. Stout
*Attorney, Agent, or Firm*—Albert L. Jeffers; Anthony Niewyk

[57] ABSTRACT

In a rotary hermetic compressor an improved bearing is provided which is attached to the housing of the compressor at three points located circumferentially equidistantly spaced around the bearing. The compressor cylinder is secured to the bearing. The bearing is held in compression against the housing whereby the housing acts as a spring so that variations in the outside diameter of the bearing can be accommodated by the spring action of the housing.

12 Claims, 7 Drawing Figures

MAIN BEARING FOR A ROTARY COMPRESSOR

BACKGROUND OF THE INVENTION

This invention pertains to a hermetic rotary compressor for compressing refrigerant in refrigeration systems such as refrigerators, freezers, air conditioners and the like. In particular, this invention relates to an improved main bearing for rotatably supporting the crankshaft in a rotary hermetic compressor.

Prior art hermetic rotary compressors generally comprise a casing or housing surrounding the working parts of the compressor. The housing is hermetically sealed to prevent compressed gas from escaping and to prevent dust and other contaminants from entering the housing. Located within the housing are an electric motor for driving the compressor and a compressor pumping mechanism driven by the motor. The electric motor comprises a stator and a rotor. The stator is generally cylindrical in shape and the rotor is located inside the stator and drives the crankshaft. In general the stator is secured to the inside wall of the housing by shrink fitting. The crankshaft includes an eccentric portion which is rotatably received in the compression bore of a compressor cylinder. In many conventional prior art structures, the compressor cylinder is also secured to the housing by shrink fitting or welding. The cylinder assembly includes a roller which surrounds the crankshaft eccentric portion and is driven thereby inside the bore the cylinder assembly also includes one or more sliding vanes. The roller revolves around the bore of the cylinder as it is driven by the crankshaft and cooperates with the sliding vanes to compress refrigerant in the bore.

The dimensional tolerances necessary for proper operation of the compressor are extremely close and are generally on the order of ten thousandths of an inch. It is important that the tolerances be held very closely and to minimize gaps between working parts of the compressor to prevent leakage of compressed refrigerant and a resulting decrease in the efficiency of the compressor below acceptable levels.

The bore of the cylinder is concentric with the axis of the crankshaft and therefore needs to be aligned very precisely with the crankshaft, the crankshaft bearing and the rotor of the motor. Since in the prior art structures the stator and cylinder are attached to the housing and since the rotor is aligned with both the stator and the cylinder, the rotor must be well supported to maintain this alignment. It is crucial that the bearing is aligned with both the stator and the cylinder in order to prevent excessive gaps between the roller and sliding vanes.

One of the problems with the prior art compressors has been that the dimensional tolerances and the concentricity of the parts have been difficult to maintain during assembly of the compressor. Attachment of the cylinder and motor stator has generally been accomplished by shrink fitting and, therefore, in the prior art structures these parts have their entire circumferences in contact with the inside wall of the housing. Since the housing is relatively flexible, misalignment of the motor and cylinder can occur as the pressures within the pressurized housing fluctuate and the housing flexes. Misalignment in the motor causes air gap variations between the motor stator and rotor thereby adversely affecting performance of the motor. Furthermore, distortion can occur in the vane slot and cylinder during the shrink fitting or welding operation, thereby causing distortion and loss of clearance between the working parts of the compressor. In conventional designs, clearance must be added to compensate for this distortion, thereby increasing leakage and adversely affecting performance of the compressor. For this reason the prior art compressor cylinders have generally been of relatively heavy construction with a large axial dimension so that the process of securing the cylinders to the housing wall and the distortion forces generated thereby would not appreciably distort the cylinders and cause undesirable distortion.

In general the crankshaft is journalled in a bearing which in turn is attached to the compressor cylinder by means of threaded bolts, welding or the like. In one prior art structure the compressor bearing has been supported by a circular disc which was press fit in the housing of the compressor cylinder and welded to the housing at several points around its circumference. The housing was, therefore, in contact with the disc around its entire circumference. This structure is more expensive due to additional material and machining costs to maintain concentricity and close tolerances for press fitting to the housing.

A problem encountered with the above discussed prior art structures which use a thick cylinder with a large axial dimension has been that relatively long leakage paths exist in the compressor cylinder assembly, thereby decreasing the efficiency of the compressor. During operation of the compressor the various areas of the compressor contain refrigerant at various pressures. For instance, the bore of the compressor cylinder has both an inlet portion at suction pressure and a high pressure portion wherein the refrigerant is compressed. Furthermore, the compressor housing itself is at high pressure because compressed refrigerant is expelled from the cylinder bore directly into the housing. It is important to keep leakage of refrigerant from the high pressure areas to low pressure areas to a minimum, since such leaked refrigerant represents lost work and reduces the efficiency of the compressor. Therefore, it is important that the length of the borders dividing low and high pressure areas are made as small as possible. The height or axial dimension of the cylinder is a critical dimension affecting leakage since it is directly related to the border length dividing the high and low pressure areas in the compressor cylinder bore and around the sliding vane. For instance, the length of the seal between the sliding vane and the cylinder slot is a border dividing high and low pressures cylinder bore areas. By using a thin cylinder these critical border dimensions can be kept small and refrigerant leakage past the vane tip as well as other borders can be reduced as explained hereinabove. The problem with a thin cylinder is that welding of the cylinder to the housing causes distortion and leakage.

Another disadvantage of the heavy construction of the prior art compressor cylinders is that it adds to the weight of the compressor. Since hermetic compressors are used in household appliances compressors are preferably of lightweight construction.

One further disadvantage of the prior art structures is that the relatively large axial dimension of the compressor cylinder increases the surface area available for heat transfer to the refrigerant gas. Such heat transfer is undesirable and tends to decrease the efficiency of the compressor. It is therefore desirable that the heat transfer surface be minimized in order to optimize the efficiency of the compressor.

Yet another disadvantage of prior art rotary hermetic compressors is the cost of manufacture and assembly because of the relatively heavy construction of the compressor cylinders and the difficulty of assembling the structure to maintain close tolerances. Accordingly, it is desirable to be able to utilize a thin cylinder block.

SUMMARY OF THE INVENTION

The present invention overcomes the disadvantages of the above described prior art hermetic rotary compressors by providing an improved bearing and an improved method of attaching the bearing to the housing of the compressor.

The hermetic compressor of the present invention, in one form thereof, comprises a bearing which is attached to the housing at only three attachment points. The attachment points are arranged concentrically around the circumference of the bearing. The bearing is held in compression against the housing so that the housing can act as a spring. Since the housing is flexible, the bearing will distort the housing at the attachment points. The housing will push inwardly on the bearing at the attachment points, and because it is flexible the housing will act as a compression spring. Since the outside diameter of the bearing attachment portion is held concentric with the axis of the bearing and since there are only three attachment points located equidistantly around the bearing, the spring action of the housing will maintain the alignment of the bearing with the motor stator irrespective of the pressures within the housing. The compressor cylinder is attached to and supported by the bearing.

An advantage of the present invention is that by holding the bearing in compression against the housing the housing will act as a spring and the concentricity of the cylinder to the crankshaft and armature is easily maintained.

Another advantage of the present invention is that substantial variation and interference between the bearing and the housing can be tolerated whereby the manufacture of the compressor is less costly.

Yet another advantage of the present invention is that it allows the cylinder to be attached to the bearing rather than the housing whereby concentric assembly of the bearing, crankshaft, rotor, stator and compressor cylinder is easily accomplished and will be maintained during operation.

Still another advantage of a compressor bearing in accordance with one form of the present invention is that it allows the compressor cylinder to be attached to the bearing rather than directly to the housing. Therefore, the cylinder will not have distorting forces placed upon it during assembly and welding and can be made with a small axial dimension. The small cylinder axial dimension reduces refrigerant leakage, minimizes heat transfer and saves weight and material.

An additional advantage of the present invention is that very close tolerances can easily be held in the assembly of the compressor so that the compressor is very efficient and easy to assemble.

The compressor of the present invention, in one form thereof, includes a housing and a motor. The motor comprises a stator which is secured to the inside wall of the housing and a rotor which cooperates with the stator to rotate inside the housing. A crankshaft is driveably connected to the rotor and is driven thereby for rotation with the rotor. A bearing means for rotatably supporting the crankshaft comprises a support means for supporting the bearing. The support means is attached to the housing at a plurality of contact points spaced circumferentially around the bearing, the housing being out of contact with the support means at locations intermediate the contact points. The journalling portion of the bearing is secured to the support means concentric with the contact points and includes an aperture for rotatably receiving the crankshaft therein.

The hermetic compressor of the present invention, in one form thereof further includes a resilient housing, and a motor having a stator and a rotor. The stator is secured to the inside wall of the housing and the rotor is disposed in rotatable relationship with the stator. A crankshaft has a first end connected to the rotor and the rotor cooperates with the stator to rotatingly drive the crankshaft. A compression cylinder having an axial bore therein is disposed concentrically with said rotor. The crankshaft extends through the bore for compressing refrigerant therein. A main bearing for the crankshaft comprises first means for securing the bearing to the housing at a plurality of contact points located circumferentially around the housing, the securing means distorting the housing outwardly at the plurality of points, the housing being out of contact with the securing means at positions intermediate the plurality of points. A crankshaft journalling means is connected to the securing means and the cylinder is secured to the securing means in axial alignment with the journalling means and concentrically with the plurality of contact points.

A hermetic rotary compressor in accordance with one form of the present invention comprises a resilient housing, a motor having a stator and a rotor, the stator being secured to an inside wall of the housing. The crankshaft is driven by the rotor, the crankshaft having an eccentric portion thereon. A bearing means for rotatably supporting the crankshaft is provided, and the bearing means is secured to the housing at only three points spaced circumferentially and equidistantly around the housing. The bearing is in compression against the housing. A compression cylinder is secured to the bearing means and includes a bore, which has operably disposed therein a vane and a roller for compressing a refrigerant fluid in the bore. The roller is connected to the eccentric portion for rotation therewith.

It is an object of the present invention to provide a rotary hermetic compressor with an improved main bearing.

It is another object of the present invention to provide a compressor with a bearing which is supported at a plurality of points by the compressor housing but is not contacted continuously around its periphery by the housing as in certain prior art constructions.

It is yet another object of the present invention to provide a compressor wherein a bearing is supported by the housing at three points and is in compression against the spring action of the housing.

It is another object of the present invention to provide a compressor which is efficient, simple to construct and lightweight.

It is yet another object of the present invention to provide a compressor which is energy efficient.

BRIEF DESCRIPTION OF THE DRAWINGS

The above mentioned and other features and objects of this invention and the manner of attaining them will become more apparent and the invention itself will be better understood by reference to the following description of an embodiment of the invention taken in connection with the accompanying drawings, wherein.

DESCRIPTION OF THE PREFERRED EMBODIMENT

Figure 1:
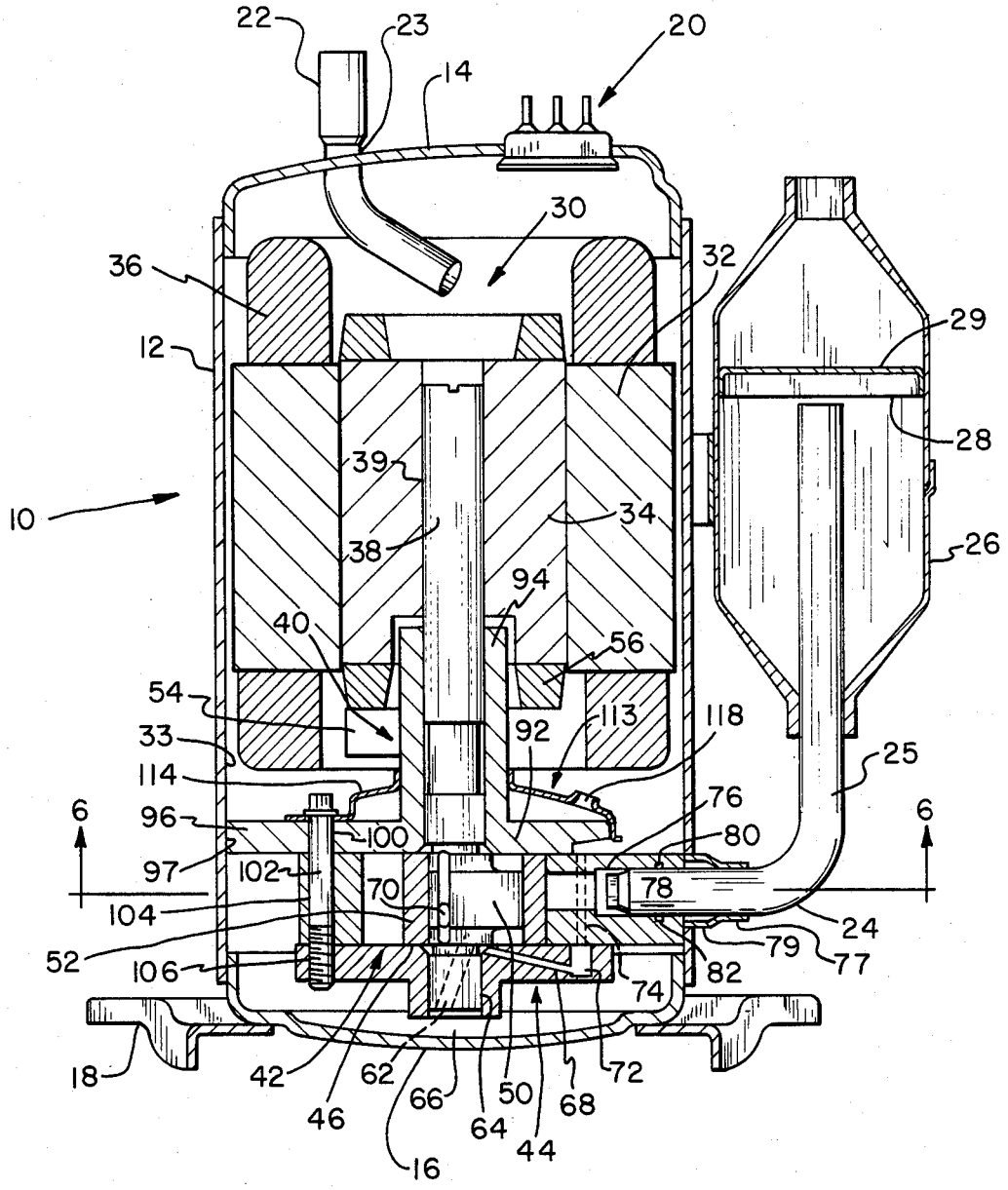
FIG. 1 is a broken-away side sectional view of the compressor.

Referring to FIG. 1 there is shown a side sectional view of the compressor with the compressor disposed vertically. A casing or housing 10 has a cylindrical portion 12 and a top and bottom portion 14 and 16, respectively. A flange 18 for supporting the compressor is welded to the bottom portion of the compressor. The flange is used for mounting the compressor to a refrigeration apparatus such as a refrigerator or freezer.

Figure 6:
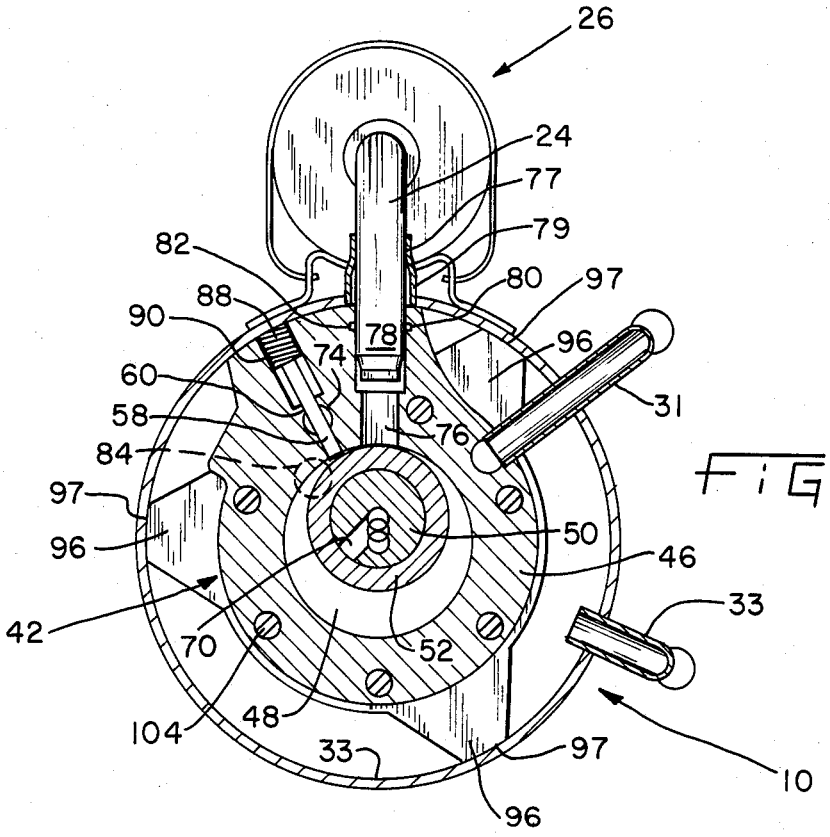
FIG. 6 is an sectional view taken along the line 6—6 of FIG. 1.

A terminal cluster 20 is provided in the top portion 14 of housing 10 for connecting the compressor to a source of electrical supply. A discharge tube 22 extends through top portion 14 of the housing 10 and into the interior of the compressor housing as shown. The tube is sealed to the housing at 23 as by soldering or brazing to prevent compressed refrigerant escaping from the housing. A suction tube 24 extends into the interior of the compressor housing as further explained hereinbelow. The end 25 of suction tube 24 which is outside of compressor housing 10 is connected to an accumulator 26. Accumulator 26 has support plates 28 disposed therein for supporting a filtering mesh 29. As best seen in FIG. 6, tubes 31 and 33 are provided for connection to a desuperheater (not shown) as is well known in the prior art.

An electric motor 30 is located inside the compressor housing. The motor includes a stator 32 and a rotor 34. Stator 32 is secured to the inside wall 33 of the housing by shrinkfitting. Electric motor 30 is of the induction type having a squirrel cage rotor 34. Windings 36 provide the rotating magnetic field for inducing rotational electric current in rotor 34 and providing the torque to drive a compressor crankshaft 38. Crankshaft 38 is secured inside the hollow interior aperture 39 of rotor 34 by shrink fitting. Crankshaft 38 extends axially through a main bearing 40, cylinder 42 and into a lower or outboard bearing 44. Crankshaft 38 is journalled in both bearings 40 and 44.

As best seen in FIGS. 1 and 6, cylinder 42 comprises a cylindrical cylinder block 46 having a bore 48 therein. An eccentric portion 50 of crankshaft 38 is located inside bore 48 for revolving eccentrically around the crankshaft axis. Cylindrical roller 52 surrounds eccentric 50 and rolls around circular bore 48 as eccentric 50 revolves around the crankshaft axis. As best seen in FIG. 1, counterweight 54 for counterbalancing eccentric 50 of crankshaft 38 is secured to end ring 56 of motor rotor 34 such as by riveting. A sliding vane 58 is received in vane slot 60 located in the cylindrical wall of the cylinder block 46. Crankshaft 38 has an axial bore 62 located in its lower portion 64 which extends into an oil sump 66. Bore 62 is directed upwardly radially outwardly and pumps oil from sump 66 upwardly to radial passage 68 in outboard bearing 44. Bore 62 is also connected by a radial passage to aperture 70 in eccentric 50 of crankshaft 38, whereby roller 52 will be lubricated. An upward portion of passage 68 conducts oil to two vane lubrication channels 74 located adjacent vane slot 60 and which are filled with oil under positive pressure supplied by oil pump 62.

An aperture 76 in the cylinder wall of cylinder block 46 receives the end 78 of suction tube 24, which end extends into the housing. Suction tube 24 is secured to housing 10 by fitting 77 which has a portion 79 extending away from tube 79. Heat for soldering fitting 77 to tube 24 is, therefore, conducted away from tube 24 into housing 10. The suction tube 24 is sealed to the aperture 76 by means of an O-ring 80 located in annulus 82 surrounding suction tube end 78. Suction tube 24 has a slightly smaller outside diameter than the inside diameter of aperture 76 so that tube 24 can slide within the aperture 76. Suction tube end 78 is sealed to the aperture 76 by O-ring 80 whereby refrigerant is prevented from escaping out of aperture 76. Aperture 76 communicates with bore 48 in cylinder 42. The tip of slidable vane 58, is urged into continuous contact with roller 52 by spring 88 located in spring pocket 90 in the wall of cylinder 42.

In operation, as roller 52 rolls around bore 50, refrigerant enters the bore through suction tube 24 and aperture 76. As the volume enclosed by vane 58, roller 52 and the wall of bore 48 is reduced in size by the rolling action of the roller, refrigerant will be compressed and will be discharged from the cylinder bore 116 through relief 84 and valve 86 located in main bearing 40.

Figure 2:
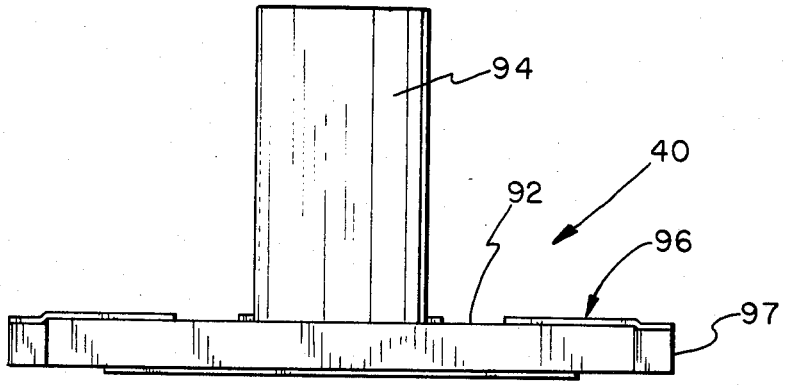
FIG. 2 is a side view of the bearing
Figure 4:
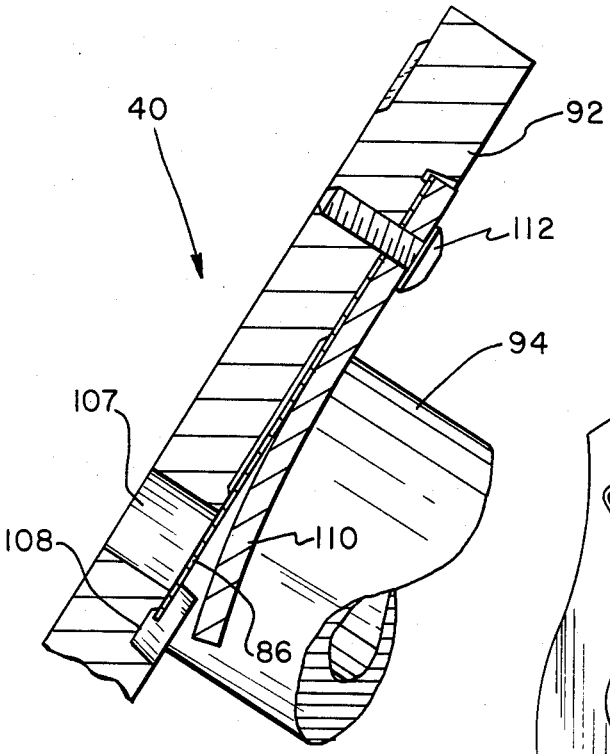
FIG. 4 is an enlarged broken-away sectional view of the bearing assembly taken along the line 4—4 of FIG. 3.
Figure 3:
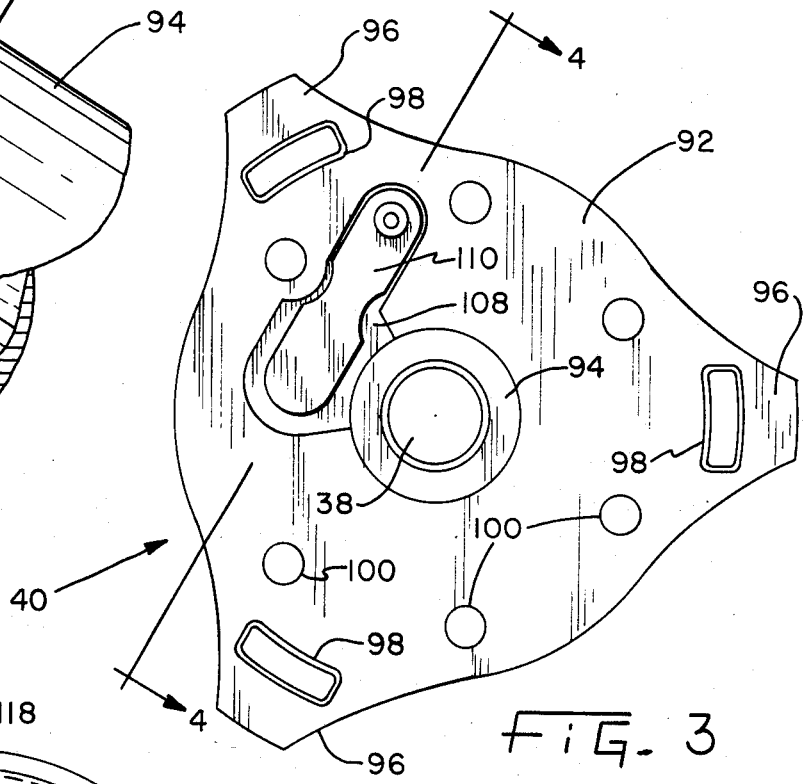
FIG. 3 is a plan view of the bearing assembly.

Turning now to FIGS. 2, 3, and 4 a main bearing 40 is shown having a planar portion 92 and cylindrical portion 94. Planar portion 92 has three attachment points or lugs 96 located thereon. The lugs are spaced equidistantly around the perimeter of portion 92 and concentrically with the axis of cylindrical portion 94. Planar portion 92 is attached to the inside wall 33 of housing 10 around the circular circumference of the housing at three points 97 as best shown in FIG. 6. Islands 98 are provided on attachment lugs 96 on planar portion 92. Cylindrical housing 10 has three holes spaced around its circumference to receive the attachment lugs 96 therein. Attachment portions 96 are welded to the housing. Islands 98 are provided for attaching welding material to planar portion 92 and for preventing weld material from spattering into housing 10.

Planar portion 92 has six holes 100 located therein. To assemble bearing 40 to cylinder 42, bolts 102 extend through holes 100 and mating holes 104 and 106 in the cylinder and lower bearing, respectively. The bolts are threaded into the lower bearing as shown in FIG. 1. If the axial dimension of the cylinder permits, bolts 102 could be replaced with 12 bolts, six of which would secure outboard bearing 44 to the cylinder and be threaded into the cylinder. The remaining six bolts would secure main bearing 40 to the cylinder and be threaded into the cylinder.

A discharge valve 86 is attached to main bearing planar portion 92 as shown in FIGS. 3 and 4. A recess 108 in portion 92 accommodates valve 86 and valve retainer 110. Stud 112 is press fit into the main bearing 40 for securing both the valve 86 and valve retainer 110 to the bearing. Aperture 107 communicates with relief 84 in cylinder 42 to discharge compressed refrigerant as discussed hereinabove.

Figure 7:
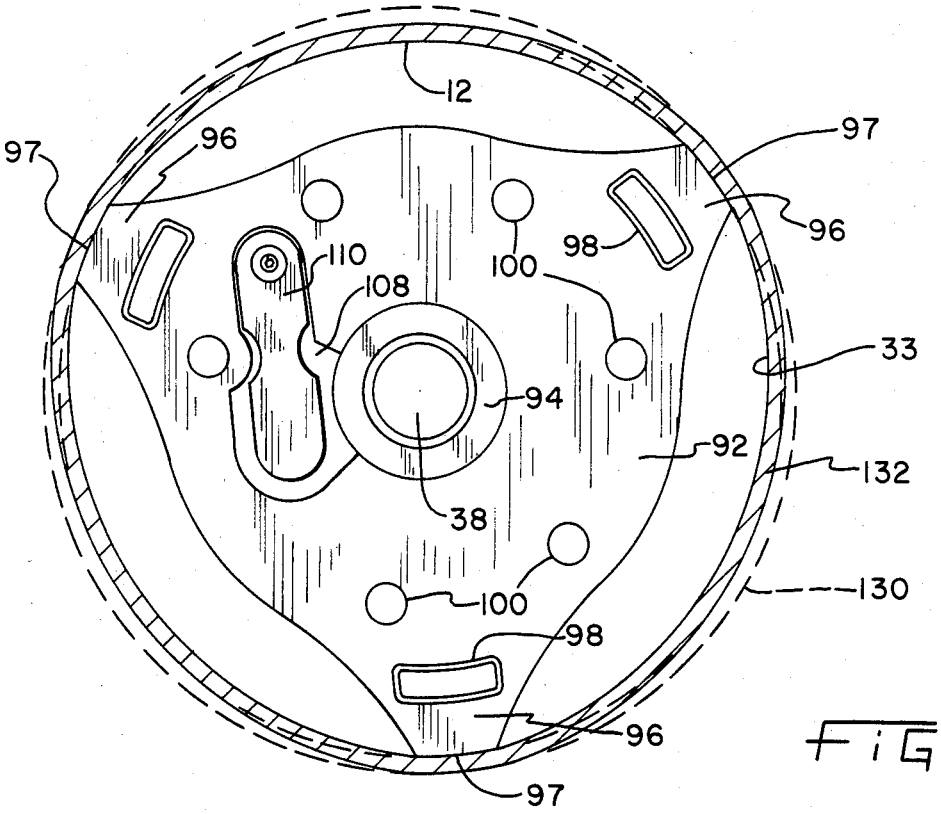
FIG. 7 is a sectional view of the bearing and housing assembly.

Cylindrical portion 94 comprises a sleeve bearing. Sleeve bearing 94 is a journalling portion and rotatably accommodates and supports the crankshaft 38. Since motor armature 34 is attached to crankshaft 38 the armature is also supported by journalling or bearing portion 94. Bearing 40 is held in compression against inside wall 33 of housing 10 at the three attachment points 97 so that the housing wall will act as a spring. Since housing 10 is flexible, bearing 40 will distort the housing at the attachment points 97. Housing 10 will push inwardly on the bearing 40 at the attachment points 97 and because of the flexibility of housing 10 the housing wall will act as a compression spring which is in compression. In FIG. 7 the housing has been shown in both its distorted state wherein it is in compression and in its normal undistorted state prior to assembly of bearing into the housing. The dotted outline 130 of housing wall 12 shows the undistorted form of the housing prior to assembly of the bearing 40 therein. However, once the bearing is assembled into the housing the bearing portions 96 will push outwardly on housing wall 12 and will distort housing wall 12 at points 97 as shown in solid lines 132 in FIG. 7. Housing wall 12 will, therefore, assume the noncircular form 132 as shown. Since the housing is flexible, it will accommodate variations in the outside diameter of bearing support portion 92. Because of the use of the housing 10 as a compression spring the tolerances to which the outside diameter of the planar support portion 92 must be held need not be as close as would be the case if the entire circumference of the bearing were in contact with the housing 10. Only the concentricity of bearing portion 94 with the outside diameter of attachment points 97 needs to be maintained accurately. The bearing can be manufactured from different types of materials. It has been found that powdered metal is a suitable material.

Figure 5:
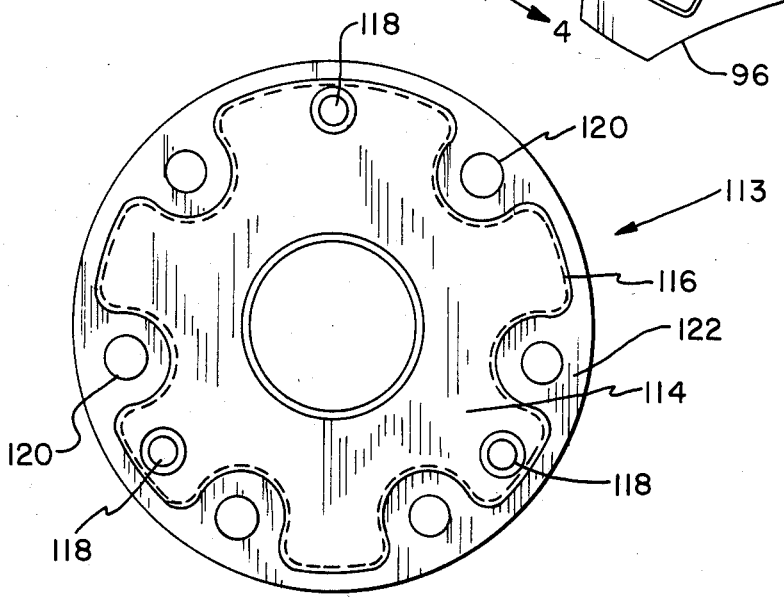
FIG. 5 is a plan view of the discharge muffler.

FIG. 5 shows an enlarged plan view of discharge muffler 113. It can be seen by referring to FIG. 1 that the discharge muffler has a raised portion 114 as outlined by dotted line 116. Holes 118, of which three are provided, allow the compressed refrigerant to exit the muffler and enter directly into the motor windings. Apertures 120 are provided in the flat portions 122 of discharge muffler 113 to fasten the discharge muffler to the main bearing 40 by means of bolts 102 as described hereinabove.

While planar portion 92 of the bearing 40 has been disclosed as a generally triangular platform, this shape may be varied without deparing from the spirit of the invention as long as the attachment of planar portion 92 to the housing 10 is at a plurality of points located concentrically with the axis of bearing 40 around the circumference of the bearing. The number of points of attachment for bearing 40 to housing 10 has been disclosed in the preferred embodiment as comprising three lugs but this need not be limited to three. Any number can be chosen as long as concentricity is maintained.

What has been disclosed is an improved compressor main bearing 40 which is attached to housing 10 at three contact points to allow for variation in the tolerances of the outside diameter of the bearing and the inside diameter of the housing. The bearing is held in compression by the housing so that the housing can act as a spring to allow for substantial variation in the interference fit. The motor stator and the bearing are both machined concentrically so that, when the bearing is welded to the housing and the stator is shrink fitted to the housing, the motor and bearing will be concentric. The compressor cylinder is bolted to the bearing and is aligned to be concentric with the bearing. By this construction variations in the outside diameter of the main bearing are not as critical as in the prior art structures. The only critical dimension is the concentricity of the outside diameter of the attachment points or lugs with the axis of the bearing. Since the compressor housing acts as a spring, variations in the outside diameter of the lugs can be accommodated by the interference fit of the housing with the mounting lugs.

While this invention has been described as having a preferred design it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. In a compressor including a resilient housing and a motor, said motor comprising a stator secured to an inside wall of said housing and, a rotor rotatably associated with said stator inside said housing, a crankshaft connected to said rotor and rotatably driven by said rotor, bearing means for rotatably supporting said crankshaft and said rotor, comprising;

support means for supporting said bearing means within said housing, said support means secured to and held in compression against said resilient housing at a plurality of contact points spaced circumferentially around the bearing means whereby said housing comprises the sole resilient support means for said bearing means, said housing being out of contact with said support means at locations intermediate said plurality of points; and journalling means secured to and supported by said support means and concentrically disposed with respect to said contact points, said journalling means including an aperture for rotatably receiving said crankshaft therein.

2. The compressor according to claim 1 wherein said support means includes a plurality of mounting lugs spaced equidistantly around the circumference of the support means.

3. The compressor according to claim 2 wherein said plurality of mounting lugs consists of three lugs.

4. The compressor according to claim 1 wherein said support means comprises a planar portion including three mounting lugs spaced equidistantly circumferentially around the central axis of said planar portion.

5. The compressor according to claim 1 wherein said support means includes three lugs for attaching said bearing to said housing wall, said compressor further including a compression means for compressing refrigerant, said compressor means comprising a cylinder secured to said bearing means having a bore therein, a sliding vane and a roller, said crankshaft extending through said bore and being drivingly connected to said roller, said vane slidably received in a wall of said cylinder for cooperation with said roller and said bore to compress a fluid in said bore.

6. In a hermetic compressor including a resilient housing, a motor having a stator and a rotor, said stator secured to the inside wall of said housing, said rotor disposed in rotatable relationship with said stator, a crankshaft having a first end connected to said rotor, said rotor cooperating with said stator to rotatingly drive said crankshaft, a compression cylinder having an axial bore therein, and disposed concentrically with said rotor, said crankshaft extending through said bore for compressing refrigerant therein, a main bearing for said crankshaft, comprising:

first means for securing said bearing directly to said housing at a plurality of contact points located circumferentially around the housing, said resilient housing being the sole resilient support means for supporting said bearing, said securing means being held in compression by said resilient housing whereby said securing means distorts said housing outwardly at said plurality of points, said housing being out of contact with said securing means at positions intermediate said plurality of points;

means for journalling said crankshaft, connected to said securing means; and said cylinder secured to said securing means in axial alignment with said journalling means and concentrically with the plurality of contact points.

7. The compressor according to claim 6 wherein said securing means comprises a planar support platform, which is welded to said housing at said plurality of points and wherein said crankshaft journalling means comprises a sleeve bearing.

8. The compressor according to claim 6 wherein said securing means is welded to said resilient housing at said plurality of contact points.

9. The compressor according to claim 6 wherein said securing means comprises a flat portion including a refrigerant discharge valve mounted thereon, and the crankshaft journalling means comprises a cylindrical sleeve bearing.

10. A hermetic rotary compressor comprising:

a resilient housing;

a motor having a stator and a rotor, said stator being secured to an inside wall of said housing;

a crankshaft driven by said rotor, said crankshaft having an eccentric portion thereon;

bearing means for rotatably supporting said crankshaft, said bearing means secured to said resilient housing at only three points spaced circumferentially equidistantly around said housing, said bearing means being in compression against said housing whereby said housing functions as a compression spring member and the sole resilient means for supporting said bearing means; and a compression cylinder secured to said bearing means and including a bore, said bore having operably disposed therein a vane and a roller for compressing a refrigerant fluid in said bore, said roller connected to said eccentric portion for rotation therewith.

11. The compressor according to claim 10 wherein said bearing means comprises a cylindrical bearing portion secured to a planar support portion coaxial with said crankshaft and with the bearing portion axis oriented at right angles to the plane of the support portion and concentric with said three points.

12. The compressor according to claim 10 and including discharge valve means mounted on said bearing means for discharging compressed refrigerant from said cylinder into said housing.

* * * * *